US008870161B2

(12) United States Patent
Doty

(10) Patent No.: US 8,870,161 B2
(45) Date of Patent: Oct. 28, 2014

(54) PIPE FLANGE SPREADING TOOL

(75) Inventor: Arthur Doty, Round Rock, TX (US)

(73) Assignee: Arthur W. Doty, Round Rock, TX (US)

( * ) Notice: Subject to any disclaimer, the term of this patent is extended or adjusted under 35 U.S.C. 154(b) by 309 days.

(21) Appl. No.: 13/449,074

(22) Filed: Apr. 17, 2012

(65) Prior Publication Data

US 2013/0061723 A1 Mar. 14, 2013

Related U.S. Application Data

(63) Continuation-in-part of application No. 13/229,851, filed on Sep. 12, 2011.

(51) Int. Cl.

| | |
|---|---|
| ***E04G 17/06*** | (2006.01) |
| ***B25B 11/00*** | (2006.01) |
| ***B25B 25/00*** | (2006.01) |
| ***B25B 27/14*** | (2006.01) |
| ***B25B 27/16*** | (2006.01) |
| *B25B 27/00* | (2006.01) |

(52) U.S. Cl.

CPC ..... *B25B 27/16* (2013.01); *B25B 27/14* (2013.01); *B25B 27/00* (2013.01)

USPC ..... 254/104; 81/485

(58) Field of Classification Search

CPC ..... B25B 27/00; B25B 27/14; B25B 27/16

USPC ..... 254/104, 131, 42, 133 R, 93 R; 81/485; 29/278, 237, 239, 238, 253, 257, 276

See application file for complete search history.

(56) References Cited

U.S. PATENT DOCUMENTS

| | | | | |
|---|---|---|---|---|
| 4,022,010 | A * | 5/1977 | Gladenbeck et al. | 57/231 |
| 4,114,977 | A * | 9/1978 | Polidori | 439/791 |
| 2007/0220945 | A1 * | 9/2007 | Rose | 72/457 |

* cited by examiner

*Primary Examiner* — Lee D Wilson
*Assistant Examiner* — Seahee Yoon
(74) *Attorney, Agent, or Firm* — Anthony P. Ng; Russell Ng PLLC

(57) ABSTRACT

A pipe flange spreading tool is disclosed. The pipe flange spreading tool includes a pair of wedges and a retainer strap. Each of the wedges has a through-hole and a tapered end. The tapered end is configured to be forced between two pipe flanges of a pipeline to separate the pipe flanges of the pipeline. The retainer strap connects the pair of wedges via the through-holes. The retainer strap includes a first and second end loops configured to be looped around a first and second secured locations of the pipeline, respectively, in order to retain the pair of wedges with respect to the pipeline during operation.

10 Claims, 3 Drawing Sheets

PIPE FLANGE SPREADING TOOL

RELATED PATENT APPLICATION

The present patent application is a continuation-in-part of an U.S. patent application Ser. No. 13/229,851, filed on Sep. 12, 2011, the pertinent of which is incorporated herein by reference.

BACKGROUND OF THE INVENTION

1. Technical Field

The present invention relates to pipelines in general, and in particular to a pipe flange spreading tool for pipelines.

2. Description of Related Art

Pipelines are frequently utilized to transport oil or gas from one location to another. A pipeline is typically formed by multiple pipes, each pipe having flanges on opposite ends to facilitate coupling to other pipes. Multiple fasteners (e.g., threaded bolts) may be employed to secure one pipe flange to another pipe flange.

On many occasions, it is necessary to spread the flanges of corresponding pipes to facilitate pipe maintenance and/or replacement. Conventional flange spreading tools tend to be bulky, expensive and relatively difficult to operate. Consequently, it would be desirable to provide an improved flange spreading tool.

SUMMARY OF THE INVENTION

In accordance with a preferred embodiment of the present invention, a pipe flange spreading tool includes a pair of wedges and a retainer strap. Each of the wedges has a through-hole and a tapered end. The tapered end is configured to be forced between two pipe flanges of a pipeline to separate the pipe flanges of the pipeline. The retainer strap connects the pair of wedges via the through-holes. The retainer strap includes a first and second end loops configured to be looped around a first and second secured locations of the pipeline, respectively, in order to retain the pair of wedges with respect to the pipeline during operation.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
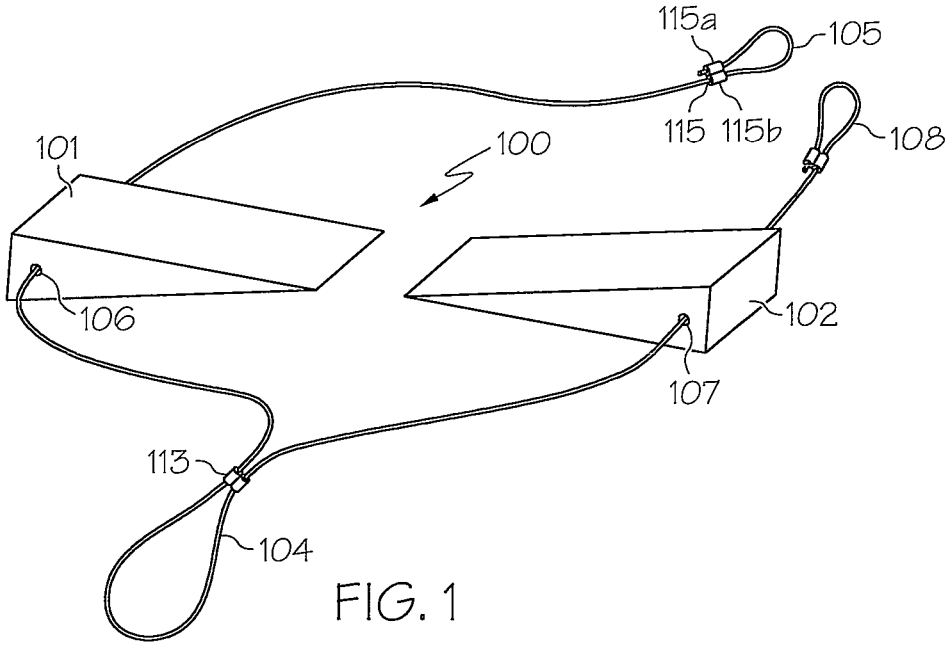
FIG. 1 is an isometric view of a pipe flange spreading tool, in accordance with a preferred embodiment of the present invention.

Referring now to the drawings and in particular to FIG. 1, there is depicted an isometric view of a pipe flange spreading tool, in accordance with a preferred embodiment of the present invention. As shown, a flange spreading tool 100 includes a first wedge 101 and a second wedge 102 secured by a retainer strap 104. One end of retainer strap 104 includes a first end loop 105, and the other end of retainer strap 105 includes a second end loop 108. First wedge 101 is substantially identical to second wedge 102. Each of first and second wedges 101, 102 has a tapered end. First wedge 101 includes a through-hole 106 that is sized to slidingly receive retainer strap 104 in a sliding fit manner. Similarly, second wedge 102 includes a through-hole 107 that is sized to slidingly receive retainer strap 104 in a sliding fit manner.

Since loop 105 is substantially similar to loop 108, only loop 105 will be described further in details. As shown, loop 105 is formed by using an aluminum fitting 115 connected to an end of retainer strap 104. Preferably, one end of retainer strap 104 is secured to a first binding 115*a* of aluminum fitting 115 (for example, first binding 115*a* is crimped to one end of retained strap 104) such that retainer strap 104 cannot be slide within first binding 115*a*, and retainer strap 104 is contained within a second binding 115*b* of aluminum fitting 115 in an interference fit manner such that the size of loop 105 can be adjusted by applying tension to retainer strap 104 to reduce its diameter in order to slide retainer strap 104 within second binding 115*b*.

Retainer strap 104 can be made of a wide variety of resilient materials. For example, retainer strap 104 may be made of a synthetic rubber material or polyurethane with a tensile strength of at least about 200 pounds per square inch (psi).

A stopper 113 is added to retainer strap 104 to prevent first and second wedges 101, 102 from sliding along retainer strap 104. Preferably, stopper 113 is interference fitted to the diameter of retainer strap 104 such that the position of stopper 113 along retainer strap 104 can be adjusted accordingly. After first and second wedges 101, 102 have been securely wedged between two pipe flanges, a user can slide stopper 113 along retainer strap 104 towards first and second wedges 101, 102 in order to reduce the slack of retainer strap 104 connected between first and second wedges 101, 102.

Figure 2:
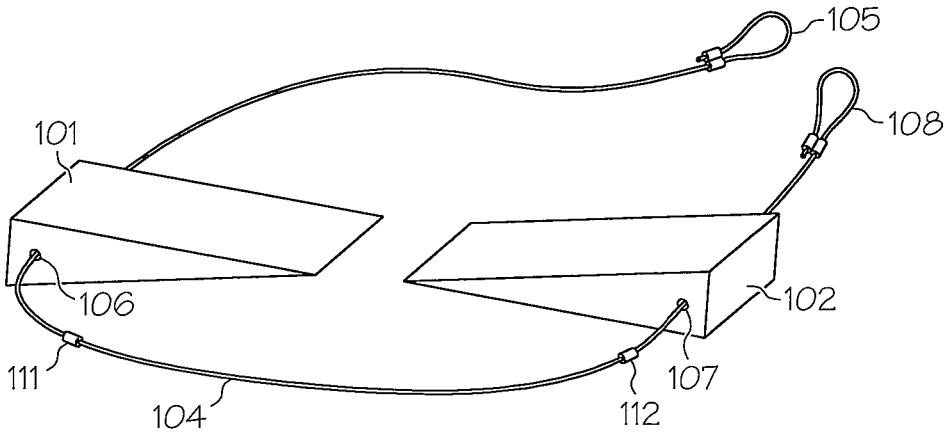
FIG. 2 is an isometric view of a pipe flange spreading tool, in accordance with an alternative embodiment of the present invention.

In FIG. 1, stopper 113 is shown as a single unit. However, stopper 113 can be split apart to form a stopper 111 and a stopper 112, as shown in FIG. 2. Both stoppers 111 and 112 are interference fitted to the diameter of retainer strap 104 such that the positions stoppers 111 and 112 along retainer strap 104 can be adjusted accordingly.

Figure 3A:
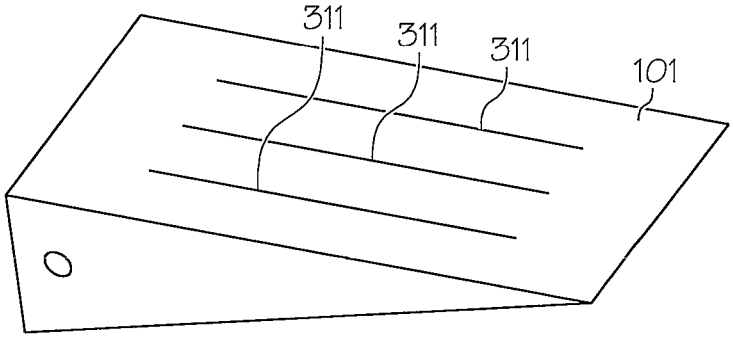
FIGS. 3A and 3B shows the guide rails on the wedges of the pipe flange spreading tool from FIG. 1.
Figure 3B:
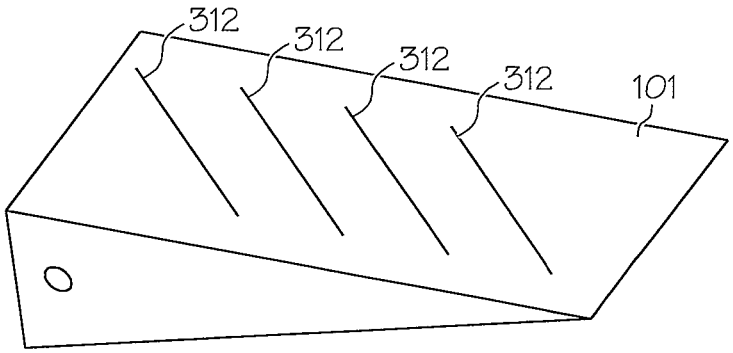

Optionally, first and second wedges 101 and 102 may include a set of guide rails on one or both sides of the surfaces. For example, as shown in FIG. 3A, first wedge 101 includes a set of guide rails 311 on the surface. In FIG. 3A, guide rails 311 are positioned in parallel with the longitudinal edge of first wedge 101. However, guide rails may also be positioned in an angle with respective to the longitudinal edge of first wedge 101, such as guide rails 312 shown in FIG. 3B. The purpose of guide rails 311, 312 is for maintaining the positions of first and second wedges 101 and 102 with respective to each other during operation.

First and second wedges 101, 102 can be made of a wide variety of materials. Preferably, first and second wedges 101, 102 are casted of aluminum-bronze-copper alloy. Since aluminum-bronze-copper alloy does not produce sparks when being struck, it is suitable to be used for applications in hazardous conditions where combustible or flammable liquids, gases and dust residues are present in pipelines. Such hazardous conditions are present in MRO, chemical, petrochemical, military, utility, waste management and hazmat.

Otherwise, first and second wedges 101, 102 can be forged of carbon steel for applications where denser metal structure is required to resist deforming forces that occur when first and second wedges 101, 102 must be hit hard in order to place them between pipe flanges of pipelines for carrying non-hazardous materials. Forged carbon steel is highly resistant to deforming and is longer lasting.

Figure 4:
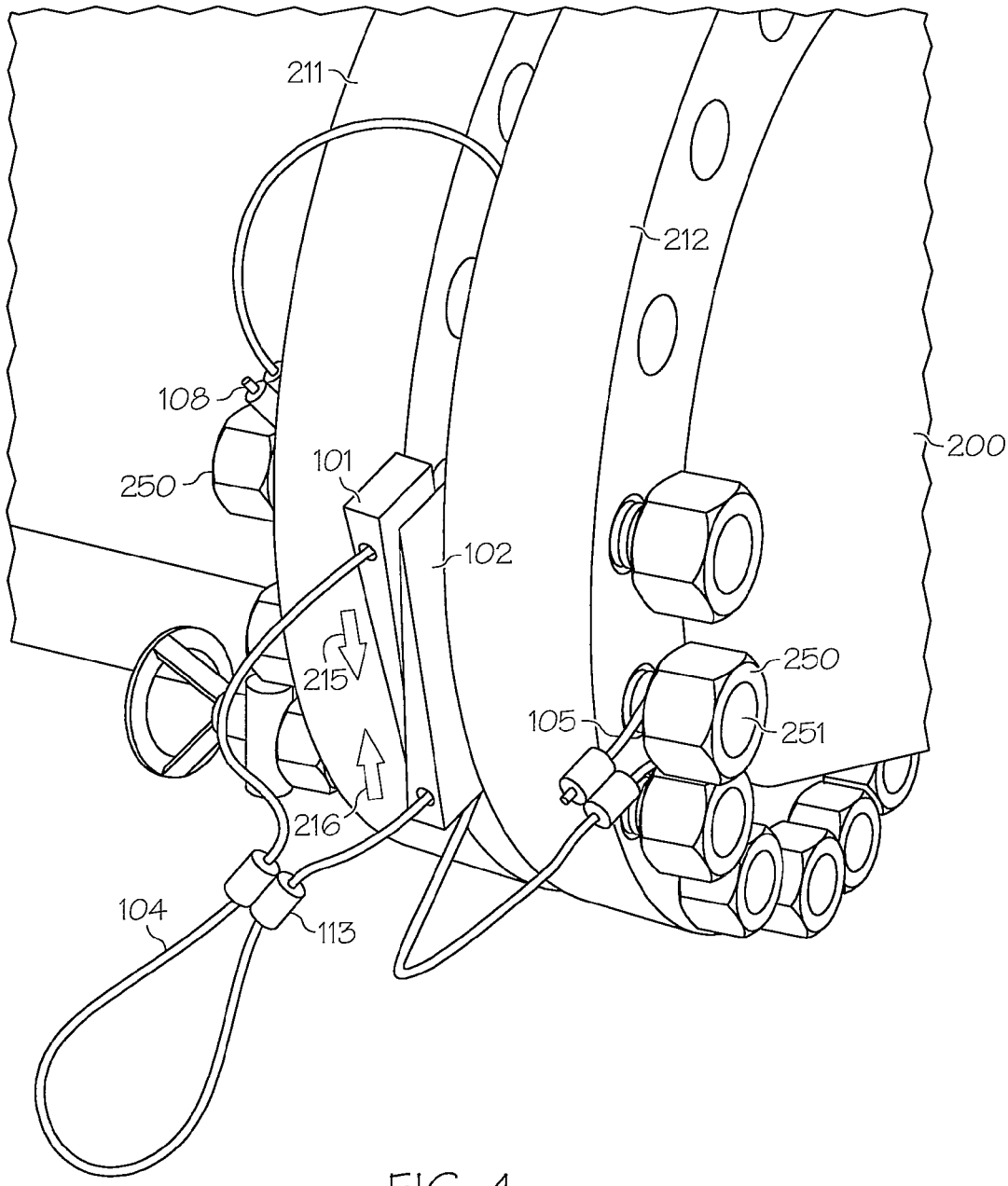
FIG. 4 is a diagram illustrating the pipe flange spreading tool from FIG. 1 being used to separate two pipe flanges.

With reference now to FIG. 4, there is depicted pipe flange spreading tool 100 being used to separate two pipe flanges. As shown, first and second wedges 101, 102 are deployed between pipe flanges 211, 212 of a pipeline 200 for spreading pipe flanges 211, 212. It should be appreciated that prior to deployment of first and second wedges 101, 102 between pipe flanges 211, 212, the fasteners (such as bolts and nuts) that mechanically coupled pipe flanges 211, 212 have already been removed and/or loosen.

Before inserting first and second wedges 101, 102 between pipe flanges 211, 212, loop 108 can be secured around a bolt 251 that is connected to a nut 250. Similarly, loop 105 can be secured around a bolt that is connected to a nut 260.

Forces can be applied to first and second wedges 101, 102 in the directions shown by arrows 215, 216 to drive first and second wedges 101, 102 between pipe flanges 211, 212 to spread them apart. The forces can be applied alternatively on first and second wedges 101, 102 via a hammer (not shown). After pipe flanges 211, 212 have been spread apart, a stop or "blind" can be inserted between pipe flanges 211, 212.

As has been described, the present invention provides a pipe flange spreading tool that is advantageously configured to separate pipe flanges while reducing the risk of injury to maintenance personnel due to flying wedges.

While the invention has been particularly shown and described with reference to a preferred embodiment, it will be understood by those skilled in the art that various changes in form and detail may be made therein without departing from the spirit and scope of the invention.

What is claimed is:

1. A tool for spreading pipe flanges, said tool comprising:

a pair of wedges each having first and second faces, a rectangular end face, and a pair of triangular side faces, said first and second faces converging together to form a tapered end extending between said triangular side faces opposite said rectangular end face, each of said wedges having a through-hole through said triangular sides faces, wherein said first face includes a plurality of guide rails substantially parallel to each other, wherein said tapered end is configured to be forced between two pipe flanges of a pipeline to separate said pipe flanges of said pipeline; and a retainer strap passing through said through-holes for connecting said pair of wedges, wherein said retainer strap, being allowed to move freely along said through-holes, includes a first end loop and a second end loop, wherein said first and second end loops are configured to be looped around a first and second secured locations of said pipeline, respectively, in order to retain said pair of wedges with respect to said pipeline during operation, wherein said first secured location is different from said second secured location.

2. The tool of claim 1, wherein said retainer strap is made of synthetic rubber.

3. The tool of claim 2, wherein said retainer strap has a tensile strength of at least approximately 200 pounds per square inch.

4. The tool of claim 1, wherein said retainer strap is made of polyurethane.

5. The tool of claim 4, wherein said retainer strap has a tensile strength of at least approximately 200 pounds per square inch.

6. The tool of claim 1, wherein said plurality of guide rails are located at an angle with an edge of said first face.

7. The tool of claim 1, wherein said tool includes a single stopper for preventing said pair of wedges from sliding along said retainer strap during operation.

8. The tool of claim 1, wherein said tool includes a pair of stoppers for preventing said pair of wedges from sliding along said retainer strap during operation.

9. The tool of claim 1, wherein said pair of wedges are made of aluminum-bronze-copper alloy.

10. The tool of claim 1, wherein said pair of wedges are made of carbon steel.

* * * * *